US011211182B2

(12) United States Patent
Adachi et al.

(10) Patent No.: US 11,211,182 B2
(45) Date of Patent: Dec. 28, 2021

(54) CABLE CONDUCTOR

(71) Applicant: Yazaki Corporation, Tokyo (JP)

(72) Inventors: Hideomi Adachi, Shizuoka (JP); Takeshi Ogue, Shizuoka (JP); Masahide Tsuru, Shizuoka (JP); Hiroyuki Yoshida, Shizuoka (JP); Kenta Yanazawa, Shizuoka (JP); Toshihiro Nagashima, Shizuoka (JP); Tetsuo Yamada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/741,941

(22) Filed: Jan. 14, 2020

(65) Prior Publication Data

US 2020/0234844 A1 Jul. 23, 2020

(30) Foreign Application Priority Data

Jan. 17, 2019 (JP) ..... JP2019-005991

(51) Int. Cl.
*H01B 7/02* (2006.01)
*H01B 7/00* (2006.01)
*H01B 7/08* (2006.01)

(52) U.S. Cl.
CPC ..... *H01B 7/0009* (2013.01); *H01B 7/0807* (2013.01)

(58) Field of Classification Search
CPC ..... H01B 7/009; H01B 7/0807; H01B 7/02; H01B 7/04; H01B 7/06; H01B 7/08; H01B 7/12
USPC ..... 174/102 R, 108, 109, 110 R, 113 R, 174/120 R
See application file for complete search history.

(56) References Cited

U.S. PATENT DOCUMENTS

| | | | | | |
|---|---|---|---|---|---|
| 2,576,163 | A * | 11/1951 | Baguley | H01B 11/18 | 174/28 |
| 9,305,681 | B2 | 4/2016 | Toyama et al. | | |
| 2011/0088944 | A1* | 4/2011 | Ogue | B60R 16/0215 | 174/72 A |
| 2012/0181059 | A1* | 7/2012 | Radermacher | H01B 9/04 | 174/115 |
| 2013/0264114 | A1* | 10/2013 | Toyama | B60R 16/0207 | 174/72 A |
| 2014/0014395 | A1* | 1/2014 | Toyama | H01B 9/006 | 174/113 R |

FOREIGN PATENT DOCUMENTS

| | | | | | |
|---|---|---|---|---|---|
| CN | 102637466 | A | | 8/2012 | |
| CN | 202905200 | U | * | 4/2013 | H01B 7/02 |
| CN | 202905200 | U | | 4/2013 | |
| CN | 203689950 | U | | 7/2014 | |
| GB | 2525546 | A | | 10/2015 | |
| JP | 2012-151056 | A | | 8/2012 | |
| JP | 2018-037324 | A | | 3/2018 | |
| NL | WO2018/202251 | A1 | * | 11/2018 | H01B 7/14 |
| TW | 200941510 | A1 | | 10/2009 | |
| WO | 2018/202251 | A1 | | 11/2018 | |

* cited by examiner

*Primary Examiner* — William H. Mayo, III
(74) *Attorney, Agent, or Firm* — Sughrue Mion, PLLC

(57) ABSTRACT

A cable conductor includes a conductor portion and an insulating material covering the conductor portion. The conductor portion includes a plurality of conductive materials having different characteristics.

1 Claim, 2 Drawing Sheets

CABLE CONDUCTOR

CROSS-REFERENCE TO RELATED APPLICATIONS

The present application is based on, and claims priority from Japanese Patent Application No. 2019-005991, filed on Jan. 17, 2019, the entire contents of which are incorporated herein by reference.

TECHNICAL FIELD

The disclosure relates to a cable conductor, and more particularly to a cable conductor applied to a wire harness that connects electric components mounted on a vehicle.

BACKGROUND

A conventional cable conductor having been known includes a positive electrode conductor functioning as a conductor portion constituting a high voltage conductive path connecting a motor and a battery provided as electric components mounted on a vehicle (see JP 2012-151056 A).

The conventional cable conductor functioning as the positive electrode conductor has a sufficient rigidity capable of maintaining the shape of the conductor along a predetermined wiring path with respect to the vehicle, while not returnable, when bent, and having an excellent route regulating capability.

SUMMARY

The conventional cable conductor includes a conductor portion formed of one kind of conductive material, so that only one characteristic of the conductive material can be reflected on one cable.

A wire harnesses formed by bundling multiple cables may include, for example, additional members to complement lacking characteristics by providing conductor portions of other cables having the lacking characteristics, but this may cause an increase of the size of the wire harness.

It is, therefore, an object of the present application to provide a cable conductor including a conductor portion having a plurality of characteristics.

A cable conductor according to some embodiments includes a conductor portion and an insulating material that covers the conductor portion, and the conductor portion includes a plurality of conductive materials having different characteristics.

The conductor portion of the cable conductor includes the plurality of conductive materials having different characteristics, so that one conductor portion can have the plurality of characteristics without using additional members other than the conductor portion.

Since the conductor portion of the cable conductor has the plurality of characteristics, there is no need to use other members, thus preventing the increase of the size of the wire harness.

The conductive materials may be formed separately each other and overlapped to form the conductor portion.

Since the conductive materials are formed separately each other and overlapped to form the conductor portion of the cable conductor, it is possible to select a plurality of conductive materials according to the surrounding environment and provide the conductor portion having a plurality of characteristics most suitable for the surrounding environment.

The conductor portion may have a circular cross-section perpendicular to a longitudinal direction.

The cable conductor including such a conductor portion having the circular cross-section perpendicular to the longitudinal direction of the conductor portion can be applied to a round conductor formed in a round shape.

The conductor portion may have a rectangular cross-section perpendicular to a longitudinal direction.

The cable conductor including such a conductor portion having the rectangular cross-section perpendicular to the longitudinal direction of the conductor portion can be applied to a flat conductor formed in a flat shape.

The cable conductor according to the embodiment includes the conductor portion capable of having a plurality of characteristics.

DETAILED DESCRIPTION

Cable conductors according to embodiments will be described with reference to FIGS. 1 to 3.

First Embodiment

A cable conductor according to a first embodiment is described with reference to FIGS. 1 and 2.

The cable conductor 1 according to the first embodiment includes a conductor portion 5 and an insulating material 3 that covers the conductor portion 5. The conductor portion 5 includes a plurality of conductive materials 7, 9 having different characteristics.

The conductive materials 7, 9 are formed separately each other and overlapped to form the conductor portion 5.

The conductor portion 5 has a circular cross-section perpendicular to the longitudinal direction.

Figure 1:
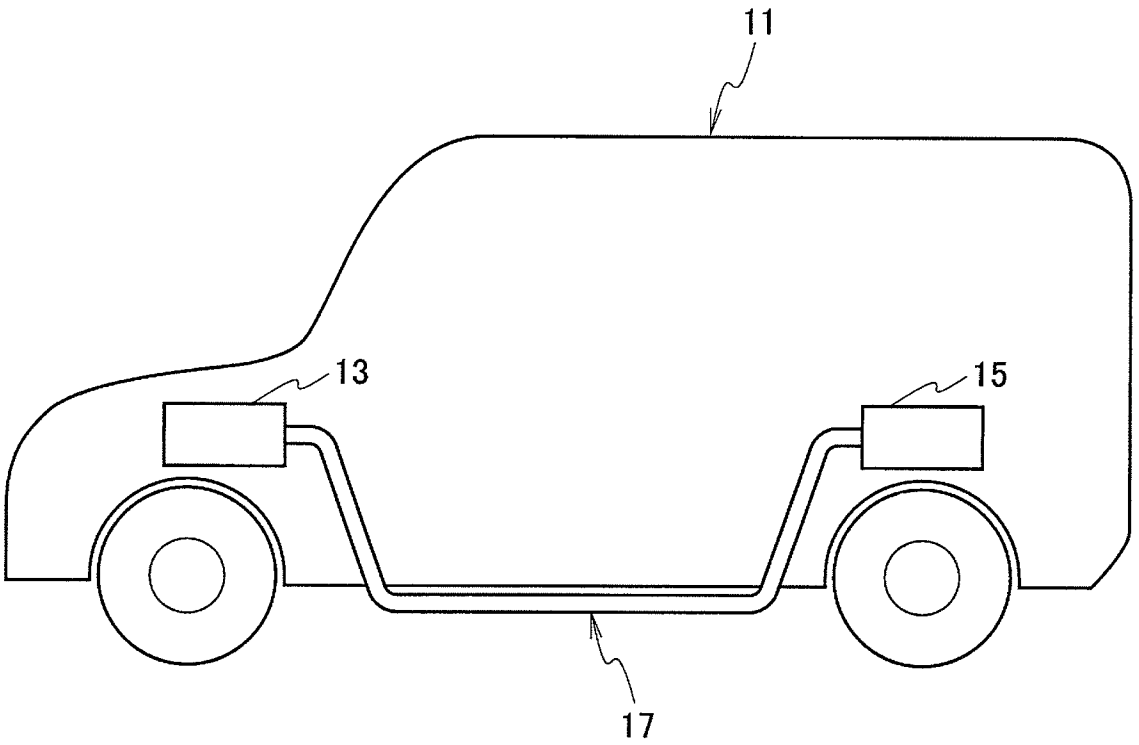
FIG. 1 is a schematic view of a vehicle including a wire harness to which a cable conductor according to embodiments is applied.

For example, as illustrated in FIG. 1, the cable conductor 1 according to the first embodiment is connected to a wire harness 17 that electrically connects an electric motor 13 and a battery 15 which are electric components mounted on a vehicle 11.

The wire harness 17 includes, for example, two high-voltage cables each having the cable conductor 1 and constituting a positive circuit and a negative circuit. Both ends of the high-voltage cables are connected to a side of the electric motor 13 and a side of the battery 15, and the cables are routed under the floor of the vehicle 11.

The cable conductor 1 applied to such a wire harness 17 is described in detail below with reference to FIGS. 1 and 2.

Figure 2:
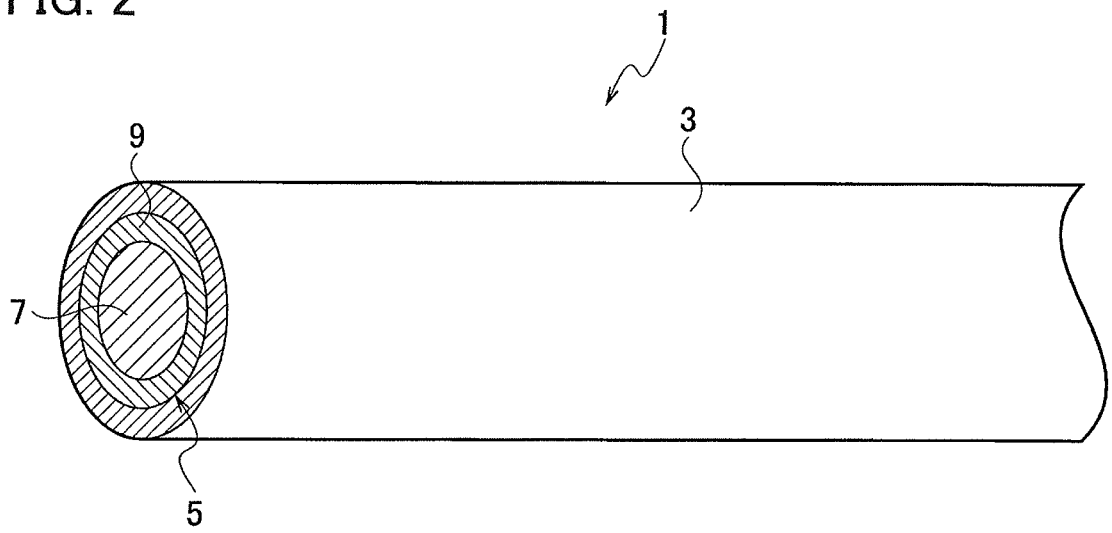
FIG. 2 is a perspective cross-sectional view of a cable conductor according to a first embodiment.

As illustrated in FIG. 2, the cable conductor 1 includes the conductor portion 5 and the insulating material 3 that covers the conductor portion 5, and the conductor portion 5 includes the plurality of conductive materials 7, 9.

The conductor portion 5 is formed as a round conductor having a circular cross-section perpendicular to the longitudinal direction. An outer circumference of the conductor portion 5 is covered with an insulating material 3 such as a synthetic resin.

A shield member (not illustrated) such as a braid or metal foil may be provided so as to cover the outer circumference of the insulating material 3.

For example, the cable conductor 1 may be used for both of the two high-voltage cables that constitute a positive circuit and a negative circuit between electric components (which are illustrated herein as the electric motor 13 and the battery 15) to constitutes the wire harness 17. The wire harness 17 is shaped into a predetermined routing shape and routed under the floor of the vehicle 11.

The conductor portion 5 is formed of the plurality of (two in the first embodiment) conductive materials 7, 9.

The conductive materials 7, 9 have different characteristics, such as, for example, the first conductive material 7 having a high conductivity and the second conductive material 9 having a high strength.

The conductive materials 7, 9 are formed such that the first conductive material 7 having a high conductivity is in a solid circular linear shape, while the second conductive material 9 having a high strength has the inner diameter substantially equal to the outer diameter of the first conductive material 7 and is in a hollow circular linear shape.

The first conductive material 7 is disposed to be inserted into the second conductive material 9 in an overlapping manner to form the conductor portion 5. The outer circumference of the conductor portion 5 is covered with the insulating material 3.

The first conductive material 7 and the second conductive material 9 are in close contact with each other and are electrically connected. The first conductive material 7 and the second conductive material 9 may or may not be coupled at the contact surface.

By forming the conductor portion 5 with the first and second conductive materials 7, 9 having different characteristics, the conductor portion 5 can have high-conductivity and high-strength characteristics.

Thus, there is no need to complement lacking characteristics by additional members when forming the wire harness 17 with the cable conductor 1, whereby it is possible to maintain a narrow diameter of the wire harness 17 and prevent the increase of the size of the wire harness 17.

Further, the first conductive material 7 and the second conductive material 9 are formed separately and are overlapped to form the conductor portion 5, whereby it is possible to select materials having various characteristics for the first conductive material 7 and the second conductive material 9 according to the surrounding environment of the vehicle 11. Thus, the conductor portion 5 can easily have a plurality of different characteristics.

The cable conductor 1 according to the first embodiment includes the conductor portion 5 formed of the plurality of conductive materials 7, 9 having different characteristics, so that one conductor portion 5 can have a plurality of characteristics without using additional members other than the conductor portion 5.

Thus, the cable conductor 1 according to the first embodiment includes the conductor portion 5 having a plurality of characteristics, so that there is no need to use additional members and the increase of the size of the wire harness 17 can be prevented.

The conductive materials 7, 9 are formed separately and overlapped to form the conductor portion 5, whereby it is possible to select the materials of the conductive materials 7, 9 according to the surrounding environment and provide the conductor portion 5 having the characteristics most suitable for the surrounding environment.

Further, the conductor portion 5 has a circular cross-section perpendicular to the longitudinal direction, so that the conductor portion 5 having the plurality of characteristics can be applied as a round conductor formed in a round shape.

Second Embodiment

A cable conductor 101 according to a second embodiment is described with reference to FIGS. 1 and 3.

The cable conductor 101 according to the second embodiment has a rectangular cross-section formed perpendicular to the longitudinal direction of a conductor portion 103.

Note that some components of the second embodiment similar to those in the first embodiment will be denoted by the same reference numerals and described with reference to the first embodiment, and that the configuration and functions of such components will not be described again, but the same effect can be achieved.

Figure 3:
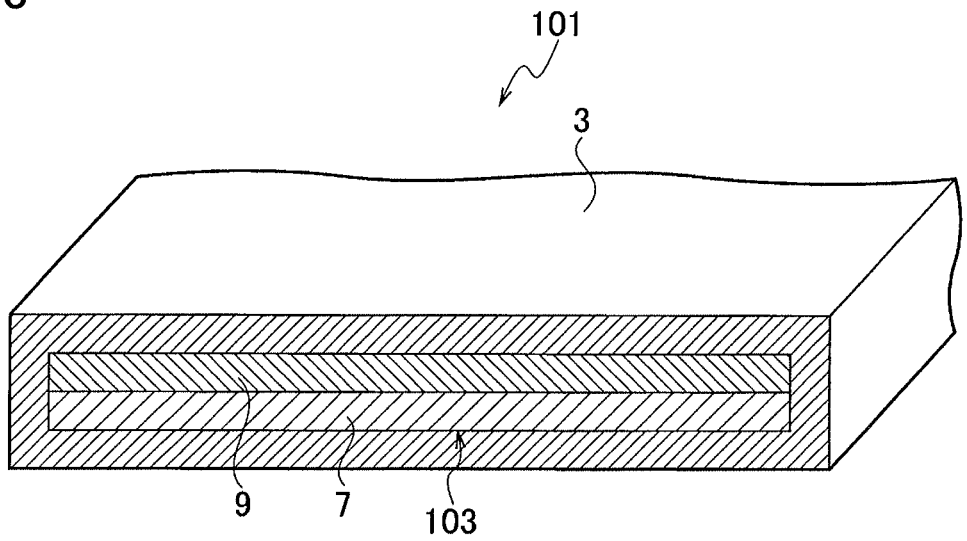
FIG. 3 is a perspective cross-sectional view of a cable conductor according to a second embodiment.

As illustrated in FIG. 3, the conductor portion 103 is formed as a flat conductor having a rectangular cross-section perpendicular to the longitudinal direction. An outer circumference of the conductor portion 103 is covered with the insulating material 3 such as a synthetic resin.

A shield member (not illustrated) such as a braid or metal foil may be provided so as to cover the outer circumference of the insulating material 3.

For example, the cable conductor 101 may be used for both of the two high-voltage cables that constitute a positive circuit and a negative circuit between electric components (which are illustrated herein as the electric motor 13 and the battery 15 in FIG. 1) to constitutes a wire harness 17 (see FIG. 1). The wire harness 17 is shaped into a predetermined routing shape and routed under the floor of the vehicle 11 (see FIG. 1).

The conductor portion 103 is formed of a plurality of (two in the second embodiment) conductive materials 7, 9.

The conductive materials 7, 9 have different characteristics, such as, for example, the first conductive material 7 having a high conductivity and the second conductive material 9 having a high strength.

The conductive materials 7, 9 are formed such that the first conductive material 7 having a high conductivity is in a solid rectangular linear shape, while the second conductive material 9 having a high strength is also in a solid rectangular linear shape similarly to the first conductive material 7.

Flat surfaces of the first conductive material 7 and the second conductive material 9 are overlapped on top of each other to form the conductor portion 103. The outer circumference of the conductor portion 103 is covered with the insulating material 3.

The first conductive material 7 and the second conductive material 9 are in close contact with each other and are electrically connected. The first conductive material 7 and the second conductive material 9 may or may not be coupled at the contact surface.

By forming the conductor portion 103 with the first conductive material 7 and the second conductive material 9 having different characteristics, the conductor portion 103, even when formed in a flat shape, can have high-conductivity and high-strength characteristics.

In the cable conductor 101 according to the second embodiment, the conductor portion 103 has a rectangular cross-section perpendicular to the longitudinal direction, so that the conductor portion 103 having the plurality of characteristics can be applied as a flat conductor formed in a flat shape.

The cable conductor according to the embodiments includes the conductor portion formed in a straight linear shape, but the shape of the conductor portion is not limited thereto and may be formed in any predetermined routing shape according to the routing shape of the vehicle in which the cable conductor is routed.

The conductor portion of the first embodiment is formed as the conductor portion 5 in which the solid first conductive material 7 is inserted into the hollow second conductive material 9, while the conductor portion of the second embodiment is formed as the conductor portion 103 in which the solid plate-like conductive materials 7, 9 are overlapped. Alternatively, for example, the conductor portion may be formed by inserting a hollow conductive material into a hollow conductive material, or formed as a twisted linear conductor by twisting a plurality of linear-shaped conductive materials having different characteristics. Thus, the conductive materials forming the conductor portion may be shaped arbitrarily.

Although the conductive materials forming the conductor portion are two conductive materials having different characteristics in the above embodiments, the conductor portion may be formed of three or more conductive materials having different characteristics.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cable conductor applied to a wire harness that connects electric components mounted on a vehicle, the cable conductor comprising:

a conductor portion; and an insulating material covering the conductor portion, wherein the conductor portion comprises a plurality of conductive materials electrically connected to each other and having different characteristics, wherein the conductor portion has a rectangular cross-section perpendicular to a longitudinal direction and the plurality of conductive materials comprises a first conductive material and a second conductive material, the first conductive material comprises a higher strength than the second conductive material, the second conductive material comprises a higher conductivity than the first conductive material, the first conductive material and the second conductive material are formed separately from each other, and the first conductive material and the second conductive material are overlapped to form the conductor portion, and the first conductive material comprises a same size and shape as the second conductive material.

* * * * *